US010607531B2

(12) United States Patent
Shang et al.

(10) Patent No.: US 10,607,531 B2
(45) Date of Patent: Mar. 31, 2020

(54) DISPLAY DRIVING CIRCUIT, DRIVING METHOD THEREOF AND DISPLAY APPARATUS

(71) Applicants: BOE Technology Group Co., Ltd., Beijing (CN); Chongqing BOE Optoelectronics Technology Co., Ltd., Chongqing (CN)

(72) Inventors: Fei Shang, Beijing (CN); Sijun Lei, Beijing (CN); Liang Gao, Beijing (CN); Guohao Li, Beijing (CN); Yong Long, Beijing (CN); Yuxu Geng, Beijing (CN); Qian Qian, Beijing (CN); Xu Lu, Beijing (CN)

(73) Assignees: BOE TECHNOLOGY GROUP CO., LTD., Beijing (CN); CHONGQING BOE OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 15/926,355

(22) Filed: Mar. 20, 2018

(65) Prior Publication Data

US 2019/0130812 A1 May 2, 2019

(30) Foreign Application Priority Data

Oct. 27, 2017 (CN) ..... 2017 1 1027474

(51) Int. Cl.
*G09G 3/20* (2006.01)
*G09G 5/00* (2006.01)

(52) U.S. Cl.
CPC ..... *G09G 3/2092* (2013.01); *G09G 5/003* (2013.01); *G09G 2310/027* (2013.01); *G09G 2330/021* (2013.01); *G09G 2370/08* (2013.01)

(58) Field of Classification Search
CPC ..... G09G 3/2092; G09G 2310/027; G09G 2330/06; G09G 5/003; G09G 2330/021; G09G 2370/08
See application file for complete search history.

(56) References Cited

U.S. PATENT DOCUMENTS

2008/0088336 A1* 4/2008 Pommerenke ..... G01R 31/002 324/754.21
2009/0079716 A1* 3/2009 Kim ..... G09G 3/2092 345/204
2011/0043512 A1* 2/2011 Ooga ..... G09G 3/3688 345/212
2015/0205438 A1* 7/2015 Kremin ..... G06F 3/0418 345/174

(Continued)

*Primary Examiner* — Kent W Chang
*Assistant Examiner* — Sujit Shah
(74) *Attorney, Agent, or Firm* — Westman, Champlin & Koehler, P.A.

(57) ABSTRACT

The disclosure discloses a display driving circuit, a driving method thereof and a display apparatus. A signal receiving antenna detects the degree of noise coupling of a pair of differential data transmission lines, and transmits to a signal compensation controller a voltage value of a coupling signal. The signal compensation controller transmits to a timer controller and/or a source IC a correction signal corresponding to the voltage value of the coupling signal, which is used to adjust differential data signals transmitted over the pair of differential data transmission lines.

16 Claims, 9 Drawing Sheets

(56) References Cited

U.S. PATENT DOCUMENTS

| | | | | |
|---|---|---|---|---|
| 2016/0125840 | A1* | 5/2016 | Oh | G09G 5/006 345/213 |
| 2016/0356828 | A1* | 12/2016 | Bacher | G01R 19/16585 |
| 2017/0179168 | A1* | 6/2017 | Suzuki | G02F 1/133553 |
| 2018/0158386 | A1* | 6/2018 | Zhang | G09G 3/3225 |

* cited by examiner

DISPLAY DRIVING CIRCUIT, DRIVING METHOD THEREOF AND DISPLAY APPARATUS

CROSS REFERENCE

This application claims priority of Chinese Patent Application No. 201711027474.5, entitled "DISPLAY DRIVING CIRCUIT, DRIVING METHOD THEREOF AND DISPLAY APPARATUS", filed on Oct. 27, 2017, which is incorporated herein in its entirety by reference.

TECHNICAL FIELD

The present disclosure relates to the field of display technologies, and in particular, to a display driving circuit, a driving method thereof, and a display apparatus.

BACKGROUND

At present, a mobile display apparatus such as a notebook computer needs a Printed Circuit Board Assembly (PCBA) to drive a display panel for data display. Specifically, as shown in FIG. 1, a control circuit board in a display apparatus is typically connected to a display panel through a Flexible Printed Circuit board (FPC), and a Timer Controller (TCON) provided on the control circuit board is typically used to transmit differential data signals to a Source Integrated Circuit (IC) provided on the display panel through a pair of differential data transmission lines. The differential data transmission lines on the FPC are susceptible to interference from external signals, and thus signal interference issues may occur in certain environments for specific tests and applications. For example, when an external mobile phone employing GSM signals approaches a notebook computer, signal interference may occur in normal data transmission for the notebook computer display, resulting in an abnormal display.

SUMMARY

In view of this, embodiments of the present disclosure provide a display driving circuit, a driving method thereof, and a display apparatus, in order to solve the issue of the conventional display apparatus that is susceptible to abnormal display due to signal interference.

Therefore, an embodiment of the present disclosure provides a display driving circuit, comprising: a source IC, a Timer Controller, a signal compensation controller, a signal receiving antenna and a pair of differential data transmission lines, wherein the timer controller is configured to transmit differential data signals to the source IC through the pair of differential data transmission lines;

the signal receiving antenna is configured to detect a coupling signal;

the signal compensation controller is electrically connected to the signal receiving antenna, and the signal compensation controller is configured to transmit a correction signal to the timer controller and/or the source IC according to a voltage value of the coupling signal received by the signal receiving antenna, wherein the correction signal corresponds to the voltage value of the coupling signal, and is used to adjust the differential data signals.

Optionally, in the display driving circuit according to an embodiment of the present disclosure, the timer controller is configured to adjust amplitudes of the output differential data signals according to the received correction signal; and/or the source IC is configured to adjust an amplification gain to be applied to the received differential data signals, according to the received correction signal.

Optionally, in the display driving circuit according to an embodiment of the present disclosure, the signal compensation controller comprises: a comparator and a register, wherein a first input of the comparator is connected to the signal receiving antenna, a second input of the comparator is connected to a voltage input terminal, and an output of the comparator is connected to an input of the register; and an output of the register is connected to the timer controller, and/or an output of the register is connected to the source IC, wherein the register is configured to output the correction signal during a blanking stage of display.

Optionally, in the display driving circuit according to an embodiment of the present disclosure, the register is further configured to output the correction signal in each blanking stage of display.

Optionally, in the display driving circuit according to an embodiment of the present disclosure, the register is further configured to output the correction signal in a blanking stage when there is a change in the output of the comparator.

Optionally, in the display driving circuit according to an embodiment of the present disclosure, the signal compensation controller further comprises a filter capacitor. One end of the filter capacitor is connected to the signal receiving antenna, and the other end of the filter capacitor is connected to Ground.

Optionally, in the display driving circuit according to an embodiment of the present disclosure, the signal compensation controller further comprises an analog to digital converter, ADC, wherein an input of the ADC is connected to an output of the comparator, and an output of the ADC is connected to the register.

Optionally, in the display driving circuit according to an embodiment of the present disclosure, the signal compensation controller comprises a plurality of comparators and a plurality of ADCs, and each of the plurality of comparators corresponds to one respective ADC.

Optionally, in the display driving circuit according to an embodiment of the present disclosure, the signal compensation controller comprises a plurality of comparators, wherein second inputs of respective comparators are connected to respective voltage input terminals having different voltage values.

Optionally, in the display driving circuit according to an embodiment of the present disclosure, the signal compensation controller further comprises: a plurality of voltage dividing resistors connected in series, wherein the number of voltage dividing resistors is greater than the number of the comparators, and in the plurality of voltage dividing resistors connected in series, one end of the voltage dividing resistor in the first stage is connected to a standard voltage input terminal, one end of the voltage dividing resistor in the last stage is connected to Ground, and each of intermediary nodes of the voltage dividing resistors of two adjacent stages is connected to a respective voltage input terminal.

Optionally, in the display driving circuit according to an embodiment of the present disclosure, a distance between the signal receiving antenna and the pair of differential data transmission lines is equal to or less than 70 μm.

Optionally, in the display driving circuit according to an embodiment of the present disclosure, a line width of the signal receiving antenna is equal to or greater than 5 times of the line width of the pair of differential data transmission lines, and is equal to or less than 10 times of the line width of the pair of differential data transmission lines.

In another aspect, an embodiment of the present disclosure also provides a method for driving the above display driving circuit, comprising:

receiving, by the signal receiving antenna, a coupling signal in real time and outputting the coupling signal to the signal compensation controller;

transmitting, by the signal compensation controller, a correction signal to the timer controller and/or the source IC according to a voltage value of the received coupling signal, wherein the correction signal corresponds to the voltage value of the coupling signal; and adjusting the differential data signals according to the correction signal.

Optionally, in the driving method according to an embodiment of the present disclosure, adjusting the differential data signals according to the correction signal comprises:

adjusting, by the timer controller, amplitudes of the received differential data signals according to the received correction signal; and/or adjusting, by the source IC, an amplification gain to be applied to the received differential data signals according to the received correction signal.

Optionally, in the driving method according to an embodiment of the present disclosure, transmitting, by the signal compensation controller, a correction signal to the timer controller and/or the source IC according to a voltage value of the received coupling signal comprises:

transmitting, by the signal compensation controller, the correction signal to the timer controller and/or the source IC according to the voltage value of the received coupling signal in each blanking stage of display.

Optionally, in the driving method according to an embodiment of the present disclosure, transmitting, by the signal compensation controller, a correction signal to the timer controller and/or the source IC according to a voltage value of the received coupling signal comprises:

transmitting, by the signal compensation controller, the correction signal to the timer controller and/or the source IC during a blanking stage of display when it is determined that the correction signal changes.

In yet another aspect, an embodiment of the present disclosure also provides a display apparatus, comprising: the above display driving circuit according to embodiments of the present disclosure, a display panel, a control circuit board and a Flexible Printed Circuit board, FPC, wherein the control circuit board is connected to the display panel through the FPC, the source IC of the display driving circuit is located on the display panel, the timer controller and the signal compensation controller of the display driving circuit are located on the control circuit board, and the signal receiving antenna and the pair of differential data transmission lines of the display driving circuit are located on the FPC.

DETAILED DESCRIPTION

Figure 1:
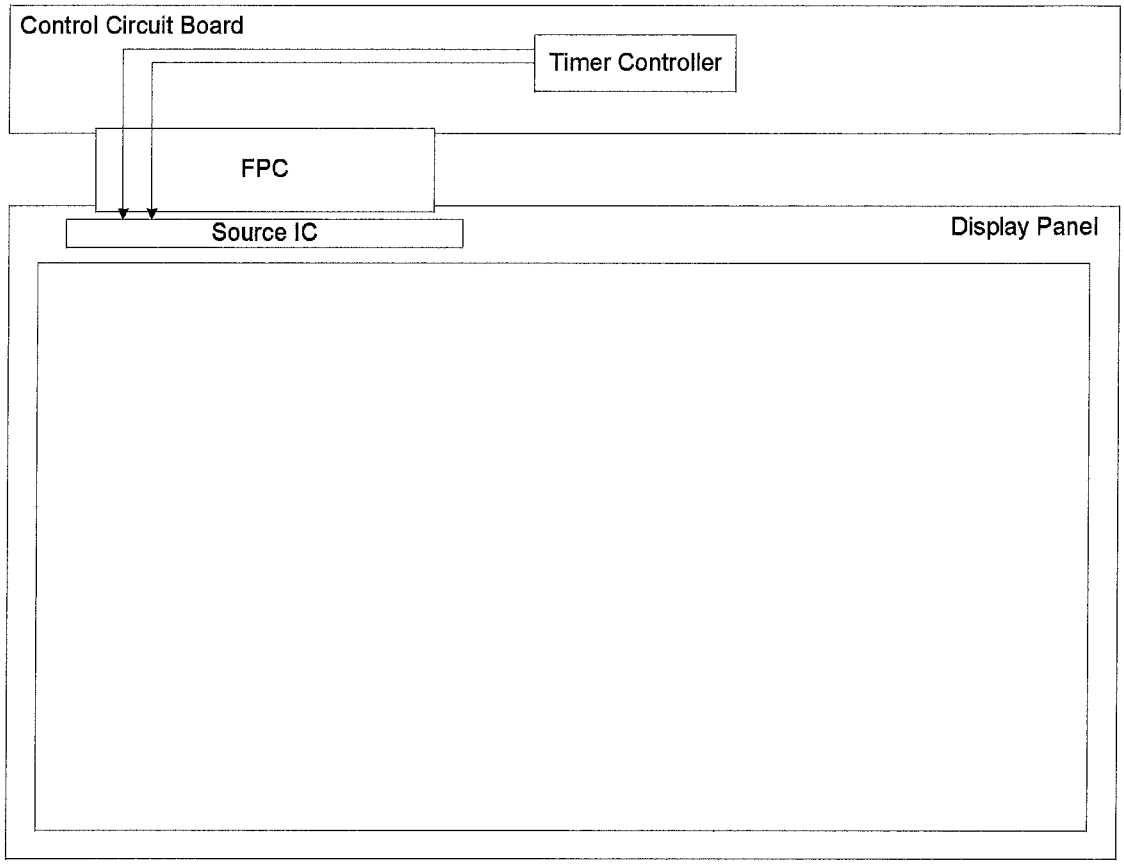
FIG. 1 is a schematic structural diagram of a display apparatus in the prior art.

Particular implementations of a display driving circuit, a driving method thereof, and a display apparatus according to embodiments of the present disclosure will be described in detail below with reference to the accompanying drawings.

The shapes and sizes of various components in the drawings are not necessarily drawn in scale, which are intended to schematically illustrate the spirit of the present disclosure only.

Figure 2A:
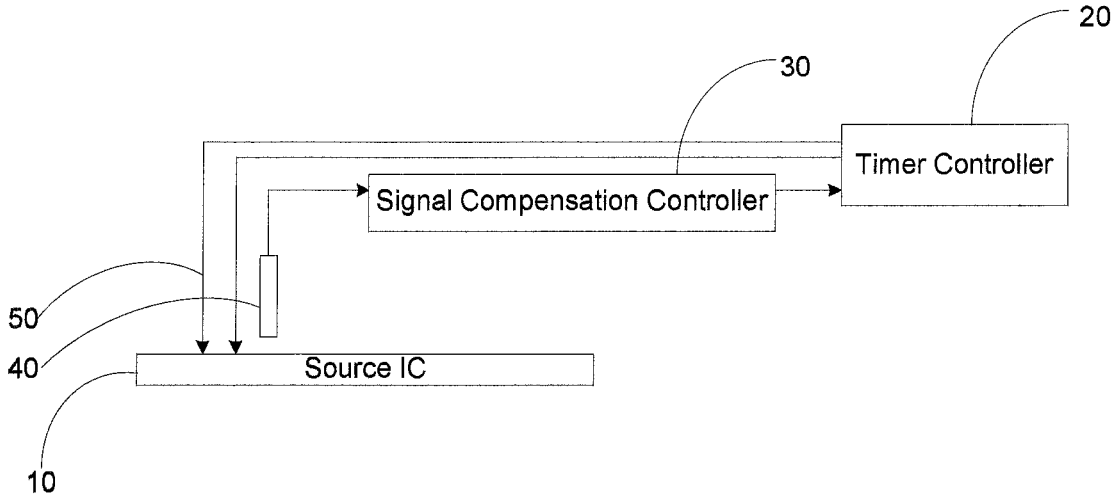
FIG. 2*a* to FIG. 2*c* are schematic structural diagrams of display driving circuits according to embodiments of the present disclosure, respectively.
Figure 2B:
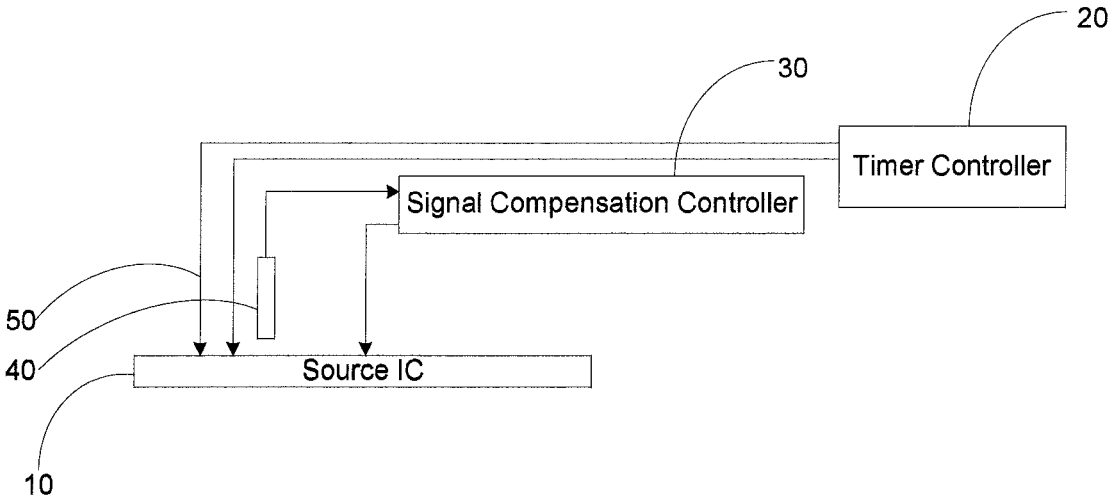
Figure 2C:
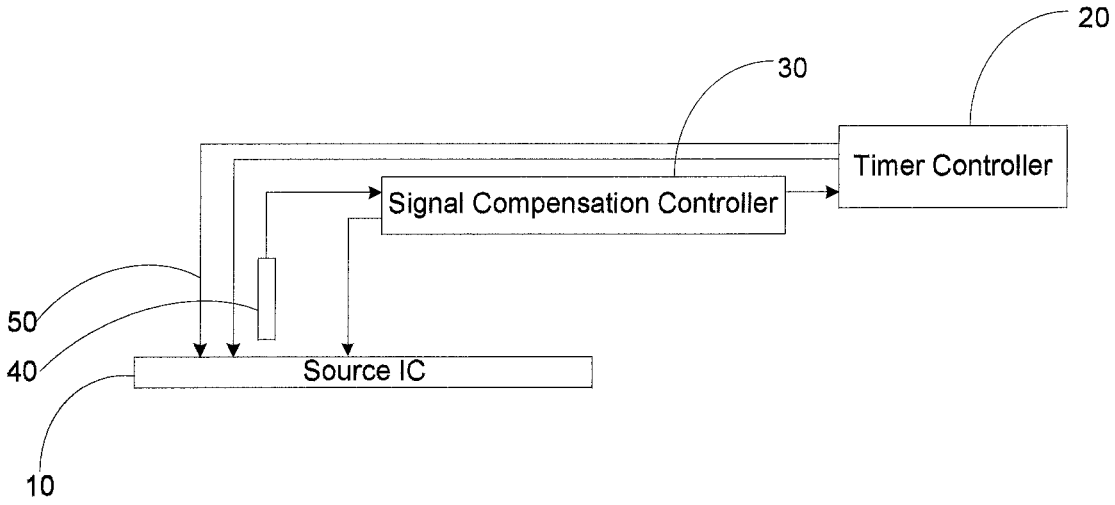

An embodiment of the present disclosure provides a display driving circuit comprising: a source IC 10, a timer controller 20, a signal compensation controller 30, a signal receiving antenna 40, and a pair of differential data transmission lines 50, as shown in FIG. 2*a* to FIG. 2*c*.

The timer controller 20 is electrically connected to the source IC 10 through the pair of differential data transmission lines 50, and is configured to transmit differential data signals to the source IC 10.

The signal compensation controller 30 is electrically connected to the signal receiving antenna 40. The signal compensation controller 30 is configured to transmit a correction signal to the timer controller 20 and/or the source IC 10 according to a voltage value of the coupling signal received by the signal receiving antenna 40, wherein the correction signal corresponds to the voltage value of the coupling signal. The correction signal is used to adjust the differential data signals.

The timer controller 20 is configured to adjust amplitudes of the received differential data signals according to the received correction signal.

The source IC 10 is configured to adjust an amplification gain to be applied to the received differential data signals, according to the received correction signal.

Specifically, in the above display driving circuit according to the embodiments of the present disclosure, during the process of the transmission of the differential data signals from the timer controller 20 to the source IC 10 through the pair of differential data transmission lines 50, the differential data signals transmitted on the pair of differential data transmission lines 50 are susceptible to the interference from external signals. Thus, the degree of noise coupling of the pair of differential data transmission lines 50 may be detected by the signal receiving antenna 40. Then a correction signal may be transmitted by the signal compensation controller 30, according to the voltage value of the coupling signal received by the signal receiving antenna 40, to the timer controller 20 and the source IC 10, wherein the correction signal corresponds to the voltage value of the coupling signal. As such, the timer controller 20 may adjust the amplitudes of the received differential data signals according to the received correction signal, and the source IC 10 may adjust the amplification gain to be applied to the received differential data signals according to the received correction signal, thereby reducing the degree of noise coupling of the differential data signals transmitted on the pair of differential data transmission lines 50 and thus improving display effect.

Specifically, in the display driving circuit according to the embodiment of the present disclosure as shown in FIG. 2*a*, the signal compensation controller 30 may transmit, to only the timer controller 20, the correction signal corresponding to the voltage value of the coupling signal, so that the timer controller 20 may adjust the amplitudes of the received differential data signals according to the correction signal. For example, after the degree of noise coupling of the differential data signals is determined, the timer controller 20 increases the amplitudes of the received differential data signals, thereby reducing the degree of noise coupling of the differential data signals. Alternatively, as shown in FIG. 2*b*, the signal compensation controller 30 may transmit, to only the source IC 10, the correction signal corresponding to the voltage value of the coupling signal, so that the source IC 10 may adjust the amplification gain to be applied to the received differential data signals according to the correction signal. For example, after the degree of noise coupling of the differential data signals is determined, the source IC 10 increases the amplification gain to be applied to the differential data signals, thereby improving the ability to discriminate differential data signals. Alternatively, as shown in FIG. 2*c*, the signal compensation controller 30 may transmit the correction signal corresponding to the voltage value of the coupling signal to both the timer controller 20 and the source IC 10 so that after the degree of noise coupling of the differential data signals is determined, the timer controller 20 increases the amplitudes of the received differential data signals, thereby reducing the degree of noise coupling of the differential data signals, while the source IC 10 increases the amplification gain to be applied to the differential data signals, thereby improving the ability to discriminate differential data signals. In this way, the effect on the display from the noise coupling is minimized.

Specifically, in the above display driving circuit according to the embodiment of the present disclosure, the signal compensation controller 30 may perform classification of the noise interference in the differential data signals according to the voltage value of the coupling signal received by the signal receiving antenna 40. For example, the noise interference may be classified into a high interference level, a median interference level, and an interference-free level, wherein each level of the noise interference has a different correction signal. Correspondingly, the timer controller 20 may store compensation coefficients corresponding to various noise interference levels, and may adjust the amplitudes accordingly after receiving a correction signal. Generally, the higher the noise interference level is, the greater the gain coefficient of the amplitudes of the differential data signals in the timer controller 20 is. When the correction signal corresponds to an interference-free level, the timer controller 20 will recover the amplitudes of the initial differential data signals, so as to save power consumption. Correspondingly, the source IC 10 may also store signal amplification gains corresponding to various noise interference levels, and may adjust the amplification gain accordingly after receiving a corresponding correction signal. Generally, the higher the noise interference level is, the greater the amplification gain to be applied to the differential data signals in the source IC 10 is. When the correction signal corresponds to an interference-free level, the source IC 10 will recover the initial amplification gain, so as to save power consumption. In the display driving circuit according to the embodiment of the present disclosure, the transmission mode of the differential data signals between the timer controller 20 and the source IC 10 can be dynamically adjusted by determining different noise interference conditions, so as to ensure that the quality of the display is not affected.

Figure 3A:
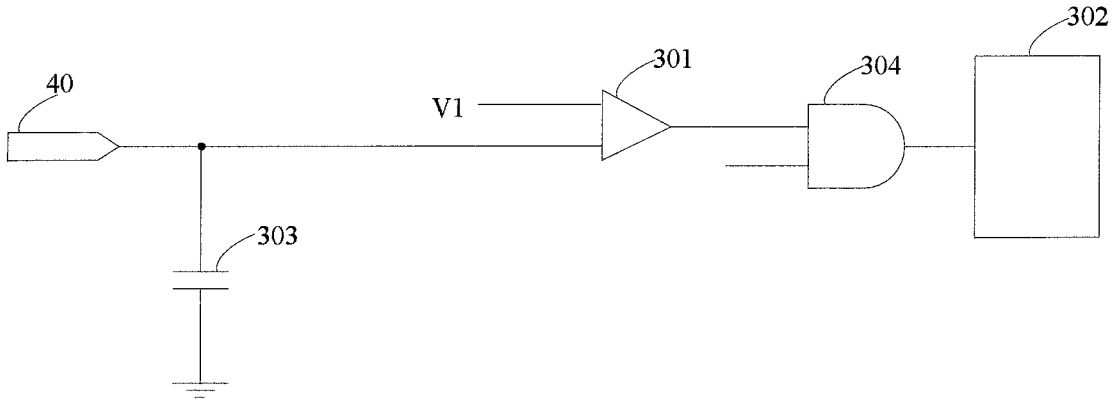
FIG. 3*a* and FIG. 3*b* are schematic diagrams of signal compensation controllers in display driving circuits according to embodiments of the present disclosure, respectively.

Optionally, in the display driving circuit according to the embodiment of the present disclosure, the signal compensation controller 30 may comprise a comparator 301 and a register 302, as shown in FIG. 3*a*.

The first input of the comparator 301 is connected to the signal receiving antenna 40, the second input of the comparator 301 is connected to the voltage input terminal V1, and the output of the comparator 301 is connected to the input of the register 302.

The output of the register 302 is connected to the timer controller 20, and/or the output of the register 302 is connected to the source IC 10. The register 302 is used to output the correction signal in the blanking stage of display.

Alternatively, in the display driving circuit according to the embodiment of the present disclosure, a number of comparators 301 may be set in the signal compensation controller 30 according to the noise interference level classification, where the number of the comparators 301 corresponds to the number of levels into which the noise interference may be classified. When the number of the comparators 301 is greater than one, the second inputs of respective comparators 301 are connected to respective voltage input terminals V1 and V2 having different voltage values, respectively, as shown in FIG. 3*b*.

For example, if the noise interference is classified into only two levels, i.e. an interference level and an interference-free level, one comparator 301 may be provided, as shown in FIG. 3*a*. If the amplitude of the coupling signal received by the comparator 301 is greater than the voltage amplitude input by the connected voltage input terminal V1, the comparator 301 outputs a first voltage signal representing the interference level. If the amplitude of the coupling signal received by the comparator 301 is lower than the voltage amplitude input by the connected voltage input terminal V1, the comparator 301 outputs a second voltage signal representing the interference-free level.

Figure 3B:
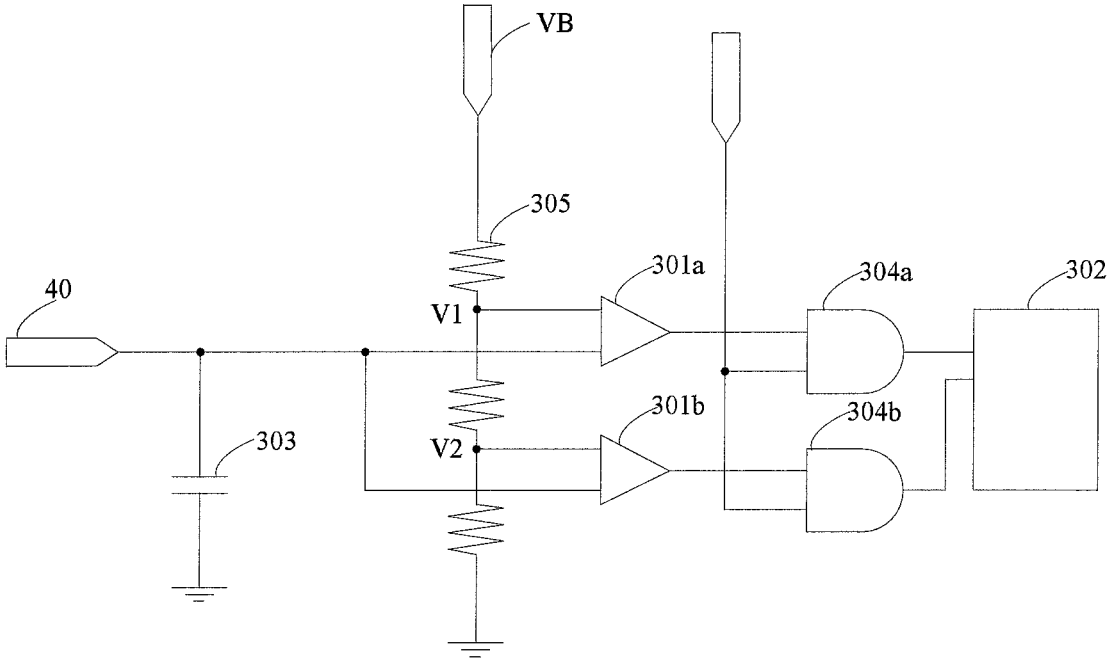

For another example, if the noise interference is classified into three levels, i.e., a high interference level, a median interference level, and an interference-free level, two comparators 301*a* and 301*b* may be provided, as shown in FIG. 3*b*. Assume the voltage value input by the voltage input terminal V1 is greater than the voltage value input by the voltage input terminal V2. If the amplitude of the coupling signal received by the comparator 301*a* is greater than the voltage amplitude input by the connected voltage input terminal V1, and the amplitude of the coupling signal received by the comparator 301*b* is greater than the voltage amplitude input by the connected voltage input terminal V2, the comparator 301*a* outputs a first voltage signal and the comparator 301*b* outputs a first voltage signal, which represents the high interference level. If the amplitude of the coupling signal received by the comparator 301*a* is lower than the voltage amplitude input by the connected voltage input terminal V1, and the amplitude of the coupling signal received by the comparator 301*b* is greater than the voltage amplitude input by the connected voltage input terminal V2, the comparator 301*a* outputs a second voltage signal and the comparator 301*b* outputs a first voltage signal, which represents the median interference level. If the amplitude of the coupling signal received by the comparator 301*a* is lower than the voltage amplitude input by the connected voltage input terminal V1, and the amplitude of the coupling signal received by the comparator 301*b* is lower than the voltage amplitude input by the connected voltage input terminal V2, the comparator 301*a* outputs a second voltage signal and the comparator 301*b* outputs a second voltage signal, which represents the interference-free level.

Optionally, in the display driving circuit according to the embodiment of the present disclosure, the register 302 may be configured to output a correction signal in each blanking stage of display. That is, regardless whether the output of the comparator 301 changes or not, the register 302 will always output a correction signal in a blanking stage of display. Accordingly, the timer controller 20 and/or the source IC 10 need to determine whether to make a corresponding adjustment or not each time when the correction signal is received.

Optionally, in the display driving circuit according to the embodiment of the present disclosure, the register 302 may be alternatively configured to output a correction signal in a blanking stage of display when there is a change in the result indicated by output(s) of respective comparator(s) 301. For example, when the result indicated by outputs of respective comparator 301 changes from a high interference level to an interference-free level, the register 302 will output a correction signal in the blanking stage of display. Accordingly, the timer controller 20 and/or the source IC 10 perform corresponding adjustments only when the correction signal is received.

Optionally, in the display driving circuit according to the embodiment of the present disclosure, the signal compensation controller 30 may further comprise a filter capacitor 303, as shown in FIGS. 3*a* and 3*b*.

One end of the filter capacitor 303 is connected to the signal receiving antenna 40, and the other end of the filter capacitor 303 is connected to Ground.

Optionally, in the display driving circuit according to the embodiment of the present disclosure, the coupling signal received by the signal receiving antenna 40 is input to the signal compensation controller 30, filtered by the filtering capacitor 303, and then input to the comparator 301. In this way, the noise in the coupling signal can be filter out, making the output of the comparator 301 more accurate.

Optionally, in the display driving circuit according to the embodiment of the present disclosure, the signal compensation controller 30 may further comprise an analog to digital converter, ADC, 304, as shown in FIG. 3*a*.

The input of the ADC 304 is connected to the output of the comparator 301, and the output of the ADC 304 is connected to the register 302.

Optionally, in the display driving circuit according to the embodiment of the present disclosure, the ADC 304 may convert the analog voltage signal output from the comparator 301 into a digital signal for storing by the register 302.

Optionally, in the display driving circuit according to the embodiment of the present disclosure, when there are multiple comparators 301, there are multiple ADCs 304, wherein each comparator 301 corresponds to one respective ADC 304, as shown in FIG. 3*b*.

For example, in the case of two comparators 301*a* and 301*b* as shown in FIG. 3*b*, the digital signals output from the respective two ADCs 304*a* and 304*b* in each of the noise interference levels are as follows:

1. in the interference-free level: the ADC 304*a* outputs 0, and the ADC 304*b* outputs 0;

2. in the median interference level: the ADC 304*a* outputs 0, and the ADC 304*b* outputs 1; and 3. in the high interference level: the ADC 304*a* outputs 1, and the ADC 304*b* outputs 1.

Figure 4:
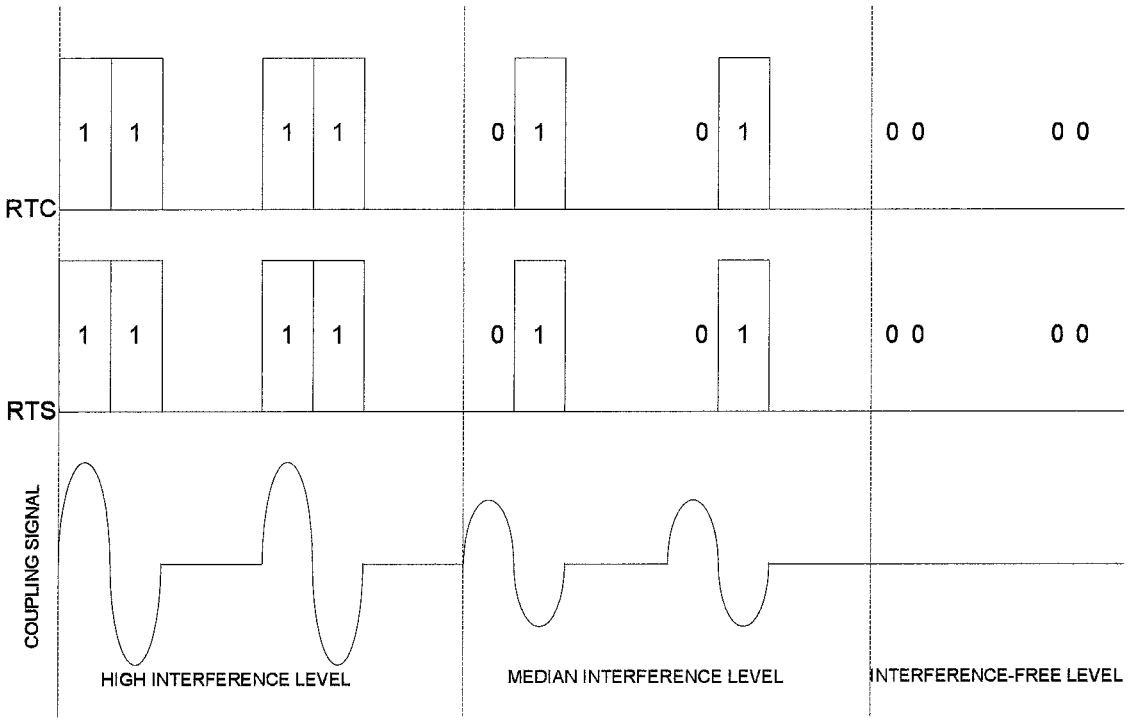
FIG. 4 is a schematic diagram of signals in a display driving circuit according to an embodiment of the present disclosure.

Optionally, the amplitude of the coupling signal, the correction signal RTC received by the timer controller 20, and the correction signal RTS received by the source IC 10 in various noise interference levels are as shown in FIG. 4.

Optionally, in the display driving circuit according to the embodiment of the present disclosure, there may be more than one comparator 301 as shown in FIG. 3*b*. FIG. 3*b* shows a case where two comparators 301 are provided. In addition, the signal compensation controller 30 may further comprise a plurality of voltage dividing resistors 305 connected in series.

The number of the voltage dividing resistors 305 is greater than the number of comparators 301.

In the plurality of the voltage dividing resistors 305 connected in series, one end of the voltage dividing resistor 305 in the first stage is connected to the standard voltage input terminal VB, and one end of the voltage dividing resistor 305 in the last stage is connected to Ground, and each of intermediary nodes of the voltage dividing resistors 305 of two adjacent stages is connected to a respective voltage input terminal V1 (V2).

Specifically, the number of the voltage dividing resistors 305 is typically greater than the number of the comparators 301. By providing the voltage dividing resistors 305, the number of the voltage input terminals V1 (V2) can be reduced, thereby simplifying the circuit structure of the control circuit board 2.

Optionally, in the display driving circuit according to the embodiment of the present disclosure, the resistances of respective voltage dividing resistors 305 may be the same, so that the voltage input by the voltage input terminal V1 (V2) may be distributed equally. Of course, in actual applications, the resistances of respective voltage dividing resistors 305 may be set as required, which is not limited herein.

Optionally, in the display driving circuit according to the embodiment of the present disclosure, the distance between the signal receiving antenna 40 and the pair of differential data transmission lines 50 should be as small as possible, typical not greater than 70 μm, to ensure that the coupling signal received by the signal receiving antenna 40 is close to the signal interference in the differential data signals transmitted by the pair of differential data transmission lines 50.

Optionally, in the display driving circuit according to the embodiment of the present disclosure, the line width of the signal receiving antenna 40 is typically equal to or greater than 5 times of the line width of the pair of differential data transmission lines 50 but is equal to or less than 10 times of the line width of the pair of differential data transmission lines 50, so as to ensure that the signal receiving antenna 40 can accurately receive the coupling signal.

Based on the same inventive concept, an embodiment of the present disclosure also provides a method for driving the above-mentioned display driving circuit. Since the principle of the driving method to solve the problem is similar to that of the aforementioned display driving circuit, the implementation of the driving method can be learned with reference to the implementation of the display driving circuit. Repeated contents will be omitted.

Figure 5:
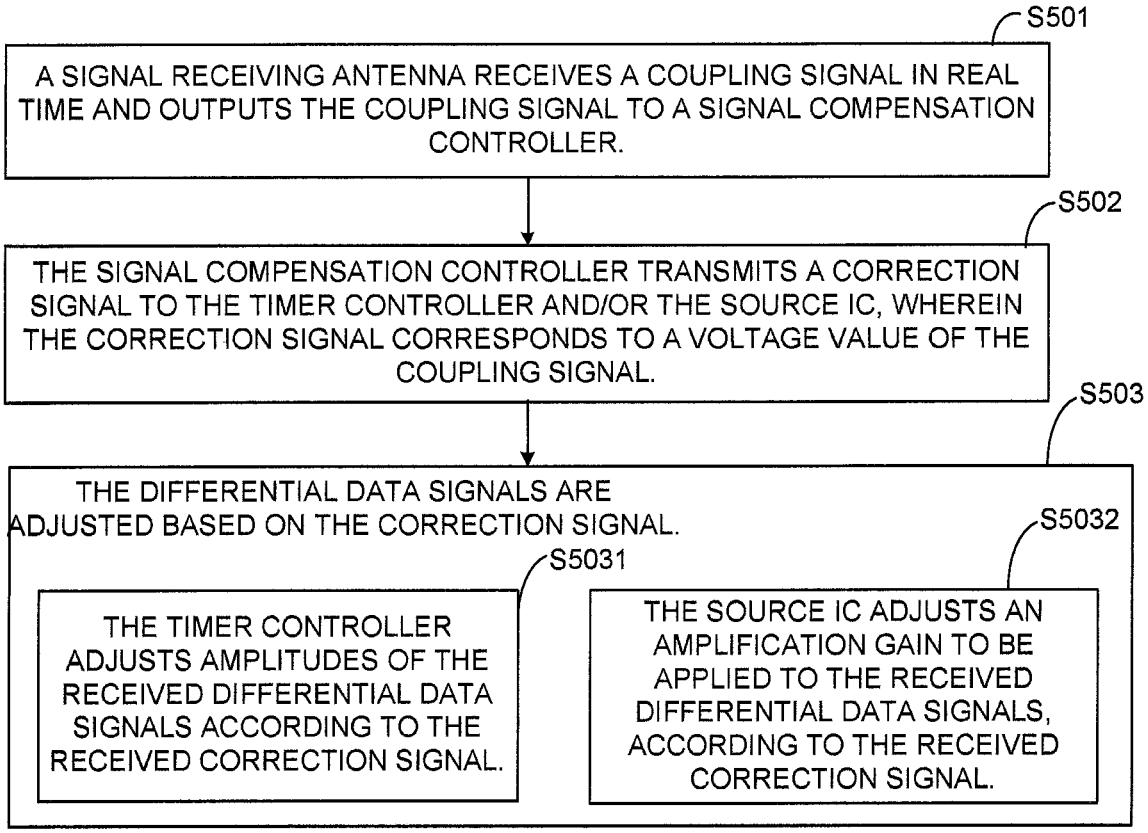
FIG. 5 is a flowchart of a method for driving a display driving circuit according to an embodiment of the present disclosure.

A method for driving the above-mentioned display driving circuit according to an embodiment of the present disclosure, as shown in FIG. 5, comprises the following steps:

S501: receiving, by the signal receiving antenna, a coupling signal in real time and outputting the coupling signal to a signal compensation controller;

S502: transmitting, by the signal compensation controller, a correction signal to the timer controller and/or the source IC according to a voltage value of the received coupling signal, wherein the correction signal corresponds to the voltage value of the coupling signal; and

S503: adjusting the differential data signals based on the correction signal.

Optionally, in the above driving method according to the embodiment of the present disclosure, step S503 may be implemented in the following manner:

S5031: adjusting, by the timer controller, amplitudes of the received differential data signals according to the received correction signal.

S5032: adjusting, by the source IC, an amplification gain to be applied to the received differential data signals, according to the received correction signal.

Optionally, in the above driving method according to the embodiment of the present disclosure, Step 502 of transmitting, by the signal compensation controller, the correction signal corresponding to the voltage value of the coupling signal to the timer controller and/or the source IC according to a voltage value of the received coupling signal may be implemented in the following manner:

The signal compensation controller always transmits the correction signal to the timer controller and/or the source IC, according to the voltage value of the received coupling signal in each blanking stage of display.

Optionally, in the above driving method according to the embodiment of the present disclosure, Step 502 of transmitting, by the signal compensation controller, the correction signal corresponding to the voltage value of the coupling signal to the timer controller and/or the source IC according to a voltage value of the received coupling signal may be implemented in the following manner:

The signal compensation controller transmits the correction signal to the timer controller and/or the source IC in a blanking stage of display when it is determined that the correction signal changes.

Based on the same inventive concept, an embodiment of the present disclosure further provides a display apparatus. The display apparatus may be any product or component with display function, such as a mobile phone, a tablet computer, a television, a monitor, a notebook computer, a digital photo frame, a navigator, and etc., which is not limited herein. The implementation of the display apparatus can be learned with reference to the implementation of the display driving circuit. Repeated contents will be omitted.

Figure 6A:
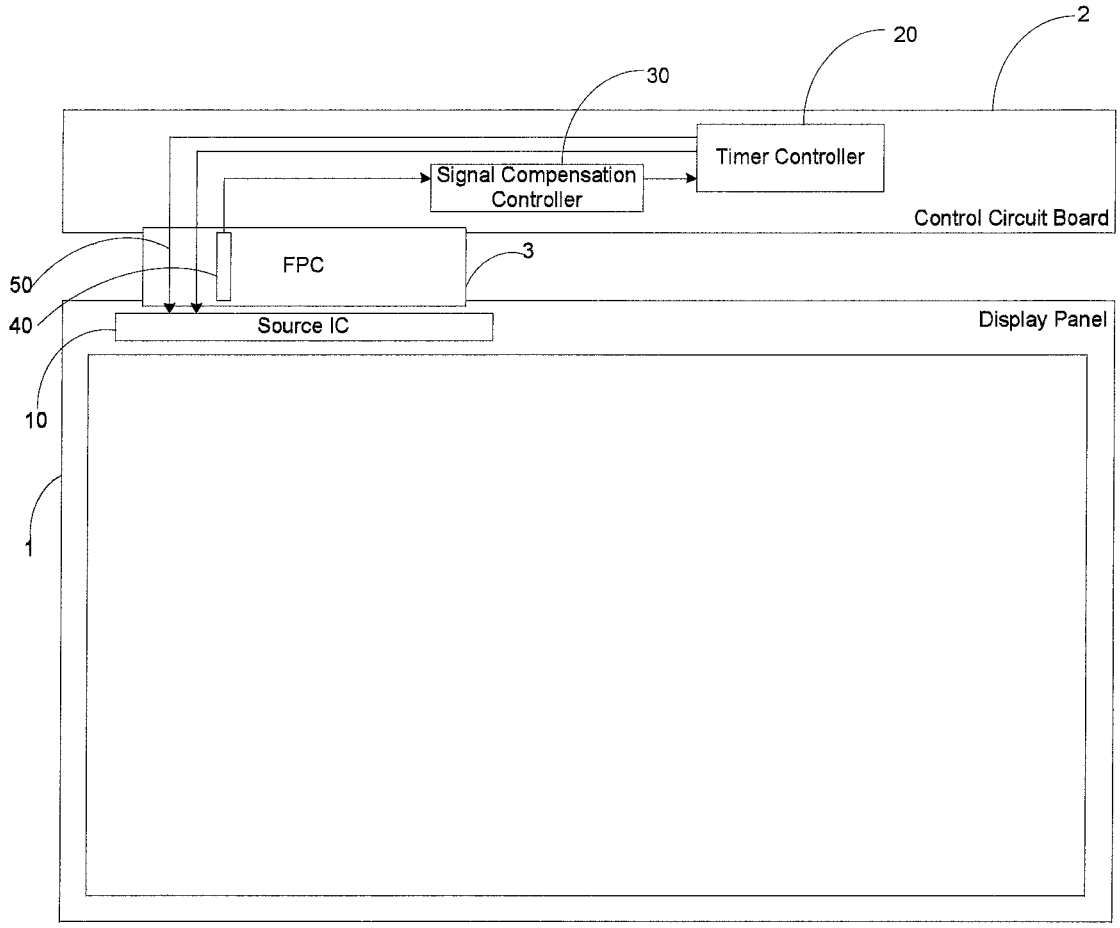
FIG. 6*a* to FIG. 6*c* are schematic structural diagrams of display apparatuses according to embodiments of the present disclosure, respectively.
Figure 6B:
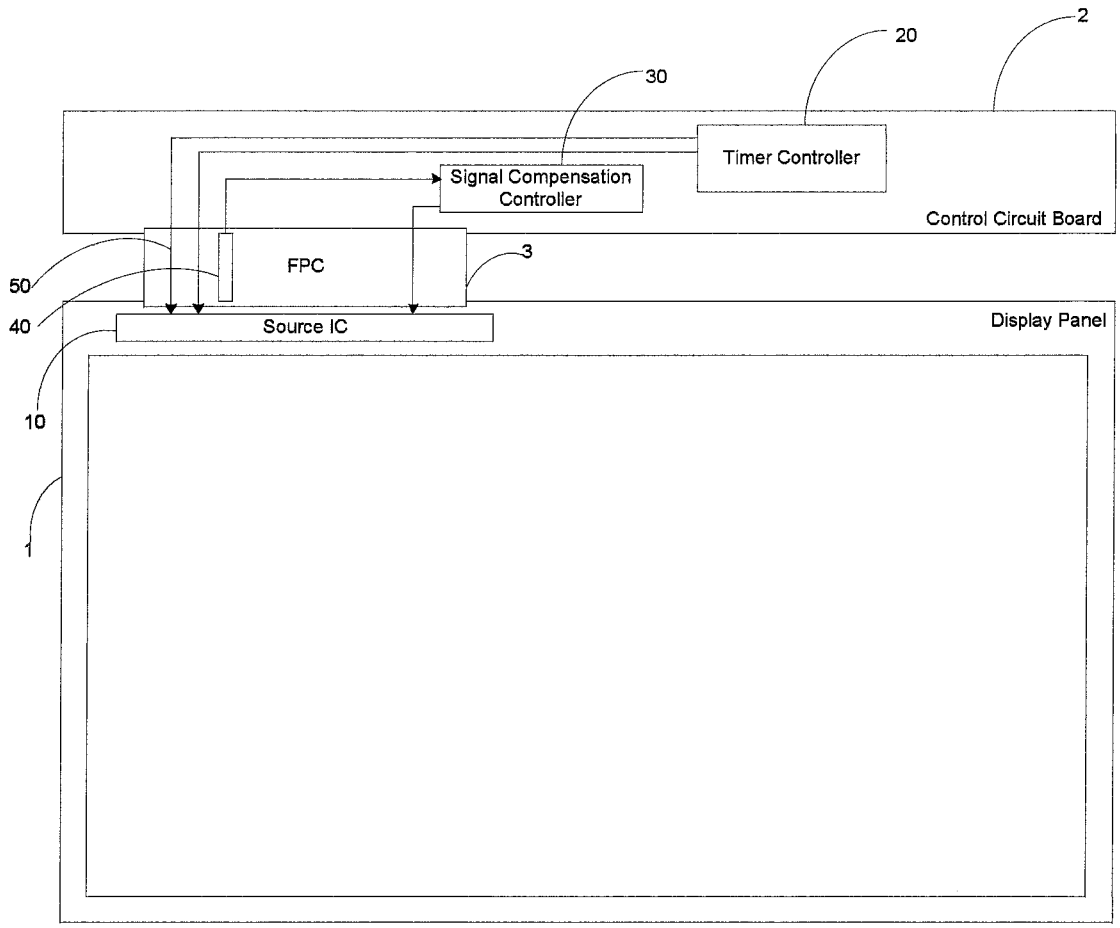
Figure 6C:
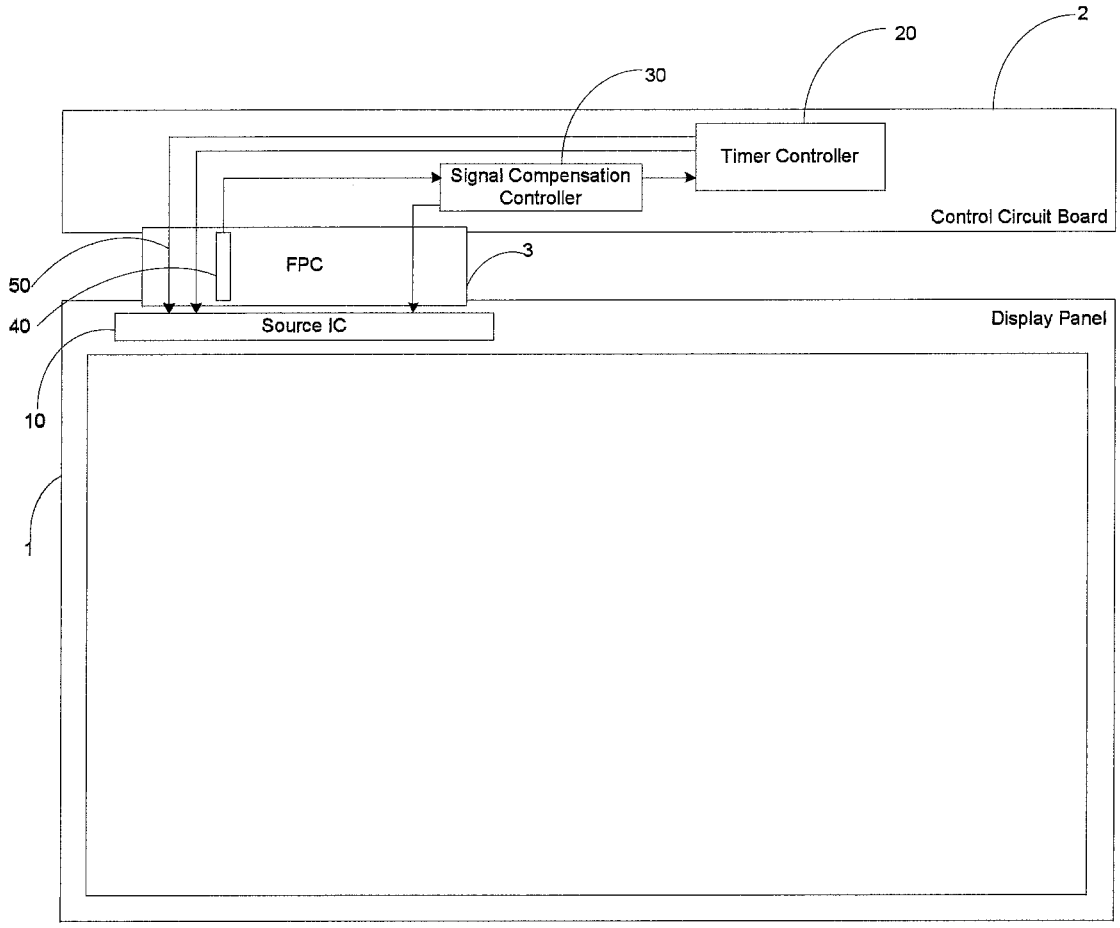

Specifically, a display apparatus according to an embodiment of the present disclosure, as shown in FIG. 6*a* to FIG. 6*c*, comprises: a display driving circuit, a display panel 1, a control circuit board 2, and a Flexible Printed Circuit board, FPC, 3.

The control circuit board 2 is connected to the display panel 1 through the FPC 3.

The source IC 10 of the display driving circuit is located on the display panel 1, the timer controller 20 and the signal compensation controller 30 of the display driving circuit are located on the control circuit board 2, and the signal receiving antenna 40 and the pair of differential data transmission lines 50 of the display driving circuit are located on the FPC 3.

Optionally, the display panel 1 in the above display apparatus according to the embodiment of the present disclosure may be a liquid crystal display panel, an organic electroluminescent display panel, or other display panels, which is not limited herein.

In the above mentioned display driving circuit, driving method and display apparatus according to embodiments of the present disclosure, the degree of noise coupling of the pair of differential data transmission lines may be detected by the signal receiving antenna. Then a correction signal may be transmitted by the signal compensation controller, according to the voltage value of the coupling signal received by the signal receiving antenna, to the timer controller and the source IC, wherein the correction signal corresponds to the voltage value of the coupling signal. As such, the timer controller may adjust the amplitudes of the received differential data signals according to the received correction signal, and the source IC may adjust the amplification gain to be applied to the received differential data signals according to the received correction signal, thereby reducing the degree of noise coupling of the differential data signals transmitted on the pair of differential data transmission lines and thus improving display effect.

It will be apparent to those skilled in the art that various modifications and variations can be made in the present disclosure without departing from the spirit and scope of the disclosure. Thus, if these modifications and variations of the present disclosure fall within the scope of the claims of the present disclosure and their equivalents, the present disclosure is also intended to cover these modifications and variations.

We claim:

1. A display driving circuit, comprising: a source Integrated Circuit (IC), a timer controller, a signal compensation controller, a signal receiving antenna and a pair of differential data transmission lines, wherein the timer controller is configured to transmit differential data signals to the source IC through the pair of differential data transmission lines;

the signal receiving antenna is configured to detect a coupling signal;

the signal compensation controller is electrically connected to the signal receiving antenna, and the signal compensation controller is configured to transmit a correction signal to the timer controller and/or the source IC according to a voltage value of the coupling signal received by the signal receiving antenna, wherein the correction signal corresponds to the voltage value of the coupling signal, and is used to adjust the differential data signals, and wherein a line width of the signal receiving antenna is equal to or greater than 5 times of the line width of the pair of differential data transmission lines but is equal to or less than 10 times of the line width of the pair of differential data transmission lines.

2. The display driving circuit according to claim 1, wherein the timer controller is configured to adjust amplitudes of the received differential data signals according to the received correction signal; and/or the source IC is configured to adjust an amplification gain to be applied to the received differential data signals, according to the received correction signal.

3. The display driving circuit according to claim 1, wherein the signal compensation controller comprises: a comparator and a register, wherein a first input of the comparator is connected to the signal receiving antenna, a second input of the comparator is connected to a voltage input terminal, and an output of the comparator is connected to an input of the register; and wherein an output of the register is connected to the timer controller, and/or an output of the register is connected to the source IC, wherein the register is configured to output the correction signal during a blanking stage of display.

4. The display driving circuit according to claim 3, wherein the register is further configured to output the correction signal in each blanking stage of display.

5. The display driving circuit according to claim 3, wherein the register is further configured to output the correction signal in a blanking stage when there is a change in the output of the comparator.

6. The display driving circuit according to claim 3, wherein the signal compensation controller further comprises a filter capacitor, and wherein one end of the filter capacitor is connected to the signal receiving antenna, and the other end of the filter capacitor is connected to Ground.

7. The display driving circuit according to claim 3, wherein the signal compensation controller further comprises an Analog to Digital Converter, ADC, and wherein an input of the ADC is connected to an output of the comparator, and an output of the ADC is connected to the register.

8. The display driving circuit according to claim 7, wherein the signal compensation controller comprises a plurality of comparators and a plurality of ADCs, and each of the plurality of comparators corresponds to one respective ADC.

9. The display driving circuit according to claim 3, wherein the signal compensation controller comprises a plurality of comparators, wherein second inputs of respective comparators are connected to respective voltage input terminals having different voltage values, respectively.

10. The display driving circuit according to claim 9, wherein the signal compensation controller further comprises: a plurality of voltage dividing resistors connected in series, wherein the number of voltage dividing resistors is greater than the number of the comparators, and in the plurality of voltage dividing resistors connected in series, one end of the voltage dividing resistor in the first stage is connected to a standard voltage input terminal, one end of the voltage dividing resistor in the last stage is connected to Ground, and each of intermediary nodes of the voltage dividing resistors of two adjacent stages is connected to a respective voltage input terminal.

11. The display driving circuit according to claim 1, wherein a distance between the signal receiving antenna and the pair of differential data transmission lines is equal to or less than 70 μm.

12. A driving method for a display driving circuit according to claim 1, comprising:

receiving, by the signal receiving antenna, a coupling signal in real time and outputting the coupling signal to the signal compensation controller;

transmitting, by the signal compensation controller, a correction signal to the timer controller and/or the source IC according to a voltage value of the received coupling signal, wherein the correction signal corresponds to the voltage value of the coupling signal; and adjusting the differential data signals according to the correction signal.

13. The driving method according to claim 12, wherein adjusting the differential data signals according to the correction signal comprises:

adjusting, by the timer controller, amplitudes of the received differential data signals according to the received correction signal; and/or adjusting, by the source IC, an amplification gain to be applied to the received differential data signals according to the received correction signal.

14. The driving method according to claim 12, wherein transmitting, by the signal compensation controller, a correction signal to the timer controller and/or the source IC according to a voltage value of the received coupling signal comprises:

transmitting, by the signal compensation controller, the correction signal to the timer controller and/or the source IC according to the voltage value of the received coupling signal in each blanking stage of display.

15. The driving method according to claim 13, wherein transmitting, by the signal compensation controller, a correction signal to the timer controller and/or the source IC according to a voltage value of the received coupling signal comprises:

transmitting, by the signal compensation controller, the correction signal to the timer controller and/or the source IC in a blanking stage of display when it is determined that the correction signal changes.

16. A display apparatus, comprising: a display driving circuit according to claim 1, a display panel, a control circuit board and a Flexible Printed Circuit board, FPC, wherein the control circuit board is connected to the display panel through the FPC, the source IC of the display driving circuit is located on the display panel, the timer controller and the signal compensation controller of the display driving circuit are located on the control circuit board, and the signal receiving antenna and the pair of differential data transmission lines of the display driving circuit are located on the FPC.

* * * * *